US007322088B2

(12) United States Patent
Sullivan et al.

(10) Patent No.: US 7,322,088 B2
(45) Date of Patent: Jan. 29, 2008

(54) QUICK RELEASE TOOL FOR ENGAGING ELONGATED OBJECTS, PARTICULARLY SUITED FOR USE WITH TUBING

(76) Inventors: Paul Joseph Sullivan, 1125 Nathan La. North, Plymouth, MN (US) 55441; Justin Joseph Sullivan, 1125 Nathan La. North, Plymouth, MN (US) 55441

( * ) Notice: Subject to any disclaimer, the term of this patent is extended or adjusted under 35 U.S.C. 154(b) by 619 days.

(21) Appl. No.: 10/351,404

(22) Filed: Jan. 27, 2003

(65) Prior Publication Data

US 2004/0143946 A1 Jul. 29, 2004

(51) Int. Cl.
*B25B 27/14* (2006.01)

(52) U.S. Cl. ..... 29/268; 29/270; 29/272

(58) Field of Classification Search ..... 29/268, 29/229, 270, 267, 242, 272
See application file for complete search history.

(56) References Cited

U.S. PATENT DOCUMENTS 4,043,333 A * 8/1977 Munsch ..... 604/86
4,884,830 A 12/1989 Meisinger
5,301,532 A * 4/1994 Bickmore et al. ..... 72/325
5,507,537 A 4/1996 Meisinger et al.
5,865,214 A * 2/1999 Stearns ..... 138/89
6,453,531 B1 * 9/2002 Krass et al. ..... 29/268

* cited by examiner

*Primary Examiner*—Lee D. Wilson
(74) *Attorney, Agent, or Firm*—Shlesinger, Arkwright & Garvey LLP

(57) ABSTRACT

Tool includes a fixed handle and a movable, lockable handle. A working end of the tool includes an upper jaw and a movable lower jaw. A passage may be provided in one or both of upper and lower jaws. A sealing device may be provided in the upper jaw, the sealing device being disposed adjacent to the passage. Lower jaw may likewise include a passage therein. In use, an elongated object such as a tube may be inserted into the passage in the lower jaw and then into the passage in the upper jaw adjacent the sealing device. When the lower jaw is engaged with the upper jaw, the lower jaw compresses the sealing device and sealingly engages the sealing device, the passage, and the tube disposed therein. In that manner, a seal is achieved. In the case where an opening having a coupling is fluidly connected to the upper jaw, a sealed, fluid connection may be established between the coupling on the upper jaw and the tube engaged by the seal.

20 Claims, 6 Drawing Sheets

QUICK RELEASE TOOL FOR ENGAGING ELONGATED OBJECTS, PARTICULARLY SUITED FOR USE WITH TUBING

CROSS REFERENCE TO RELATED APPLICATION

This application relates to applicant's concurrently filed application entitled "CONTAMINANT FLUSHING DEVICE, SYSTEM, AND METHOD, PARTICULARLY SUITED FOR REFRIGERATION SYSTEM SERVICING" (applicant's ref. no. 7280), which is incorporated herein by reference.

FIELD OF THE INVENTION

This invention relates to tools. More specifically, this invention relates to hand tools, such as gripping tools. Even more particularly, the invention relates to hand tools which are suited for gripping elongated objects, such as rods and tubes, and exerting force on or sealing openings in tubing, for example.

BACKGROUND OF THE INVENTION

Machine-actuated and hand-actuated gripping tools are known.

There is a need for a tool which is better suited to engaging elongated objects than known devices.

There is likewise a need for a tool which can engage and work on elongated objects better than known devices. Further, there is a need for a tool which can seal openings in tubes or pipes, better than known devices.

OBJECTS AND SUMMARY OF THE INVENTION

An object of the invention is to overcome the drawbacks of prior art devices.

Another object of the invention is to provide a tool which engages elongated objects better than known devices.

Another object of the invention is to provide a tool which rapidly engages and disengages from elongated objects.

A still further object of the invention is to provide a tool which can sealingly engage an elongated object.

A further object of the invention is to provide a quick-release, hand-actuated tool for engaging an elongated object.

Another object of the invention is to provide a tool which can engage an elongated object for enhanced manipulation of the elongated object.

Yet another object of the invention is to provide a tool particularly suited for use with tubing and pipes that contain fluid, particularly pressurized fluid; i.e., a fluid in which there is a pressure differential between atmospheric and the pressure inside of the tube or pipe.

In summary, the invention includes a tool including a working end and a passage provided in the working end that is configured for receiving an elongated object to be worked. A seal may be provided adjacent to the passage, the seal being configured for allowing insertion of an elongated object into the passage when the seal is in an unactuated condition. An actuator may be provided adjacent the working end that is configured for moving between an engaged position and an unengaged position, the engaged position being a position in which the actuator causes the seal to assume its engaged position. The unengaged position of the actuator being a position in which the actuator sufficiently disengages so that the seal can assume its disengaged position. When the actuator is in its disengaged position and the seal is in its disengaged position, an elongated object can be inserted into the passage and be disposed substantially adjacent to seal. When the actuator is moved into its engaged position it causes the seal to assume its engaged position, and a seal is established between the elongated object, the seal, and the passage.

The tool may be a hand tool.

The seal may include a resilient seal, such as an elastomeric bushing.

One or more passages may be provided in the tool for connecting one or more elongated objects, such as one or more pieces of tube.

It is likewise contemplated that a further actuator be provided for engaging and disengaging a seal for sealingly engaging respective ones of a plurality of elongated objects.

Relative terms such up, down, left, and right, are for convenience only and are not to be intended to be limiting.

DETAILED DESCRIPTION OF THE INVENTION

Figure 1:
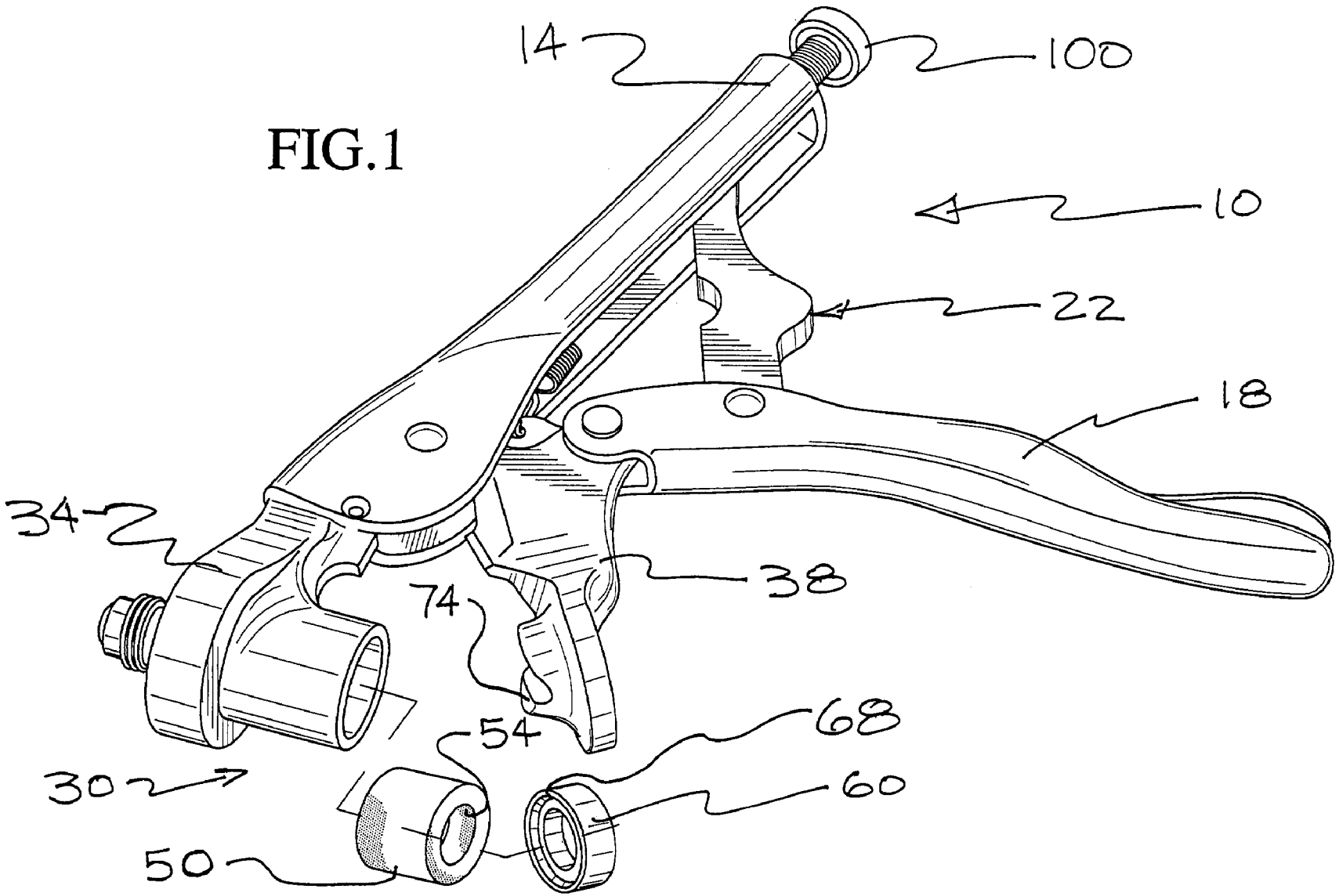
FIG. 1 illustrates a perspective view of a quick release tool embodiment according to the invention for engaging objects, the quick release tool being a hand tool.
Figure 2:
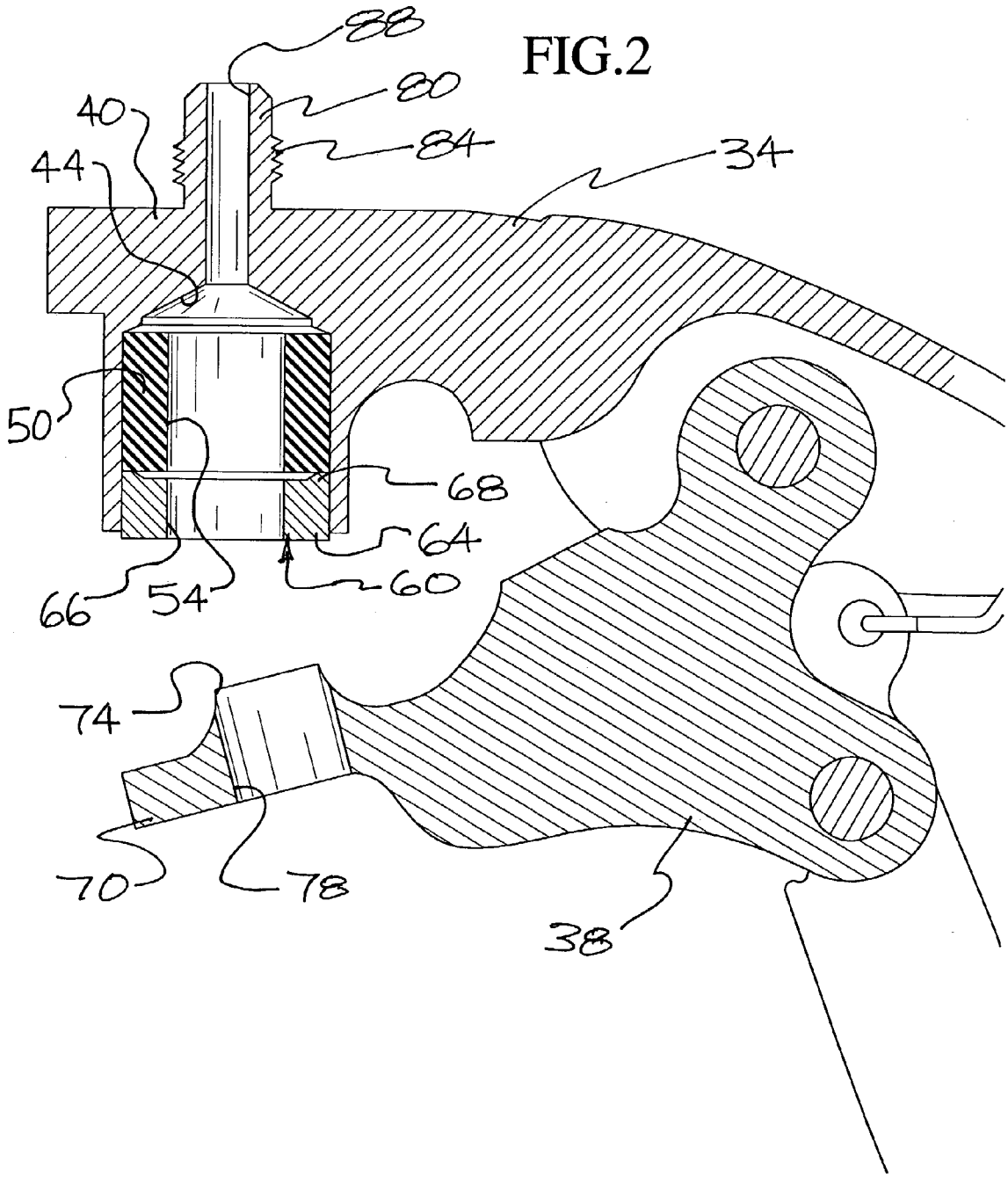
FIG. 2 is an enlarged partial cross-sectional view of the working end of the tool of FIG. 1 in an open, disengaged position.
Figure 3:
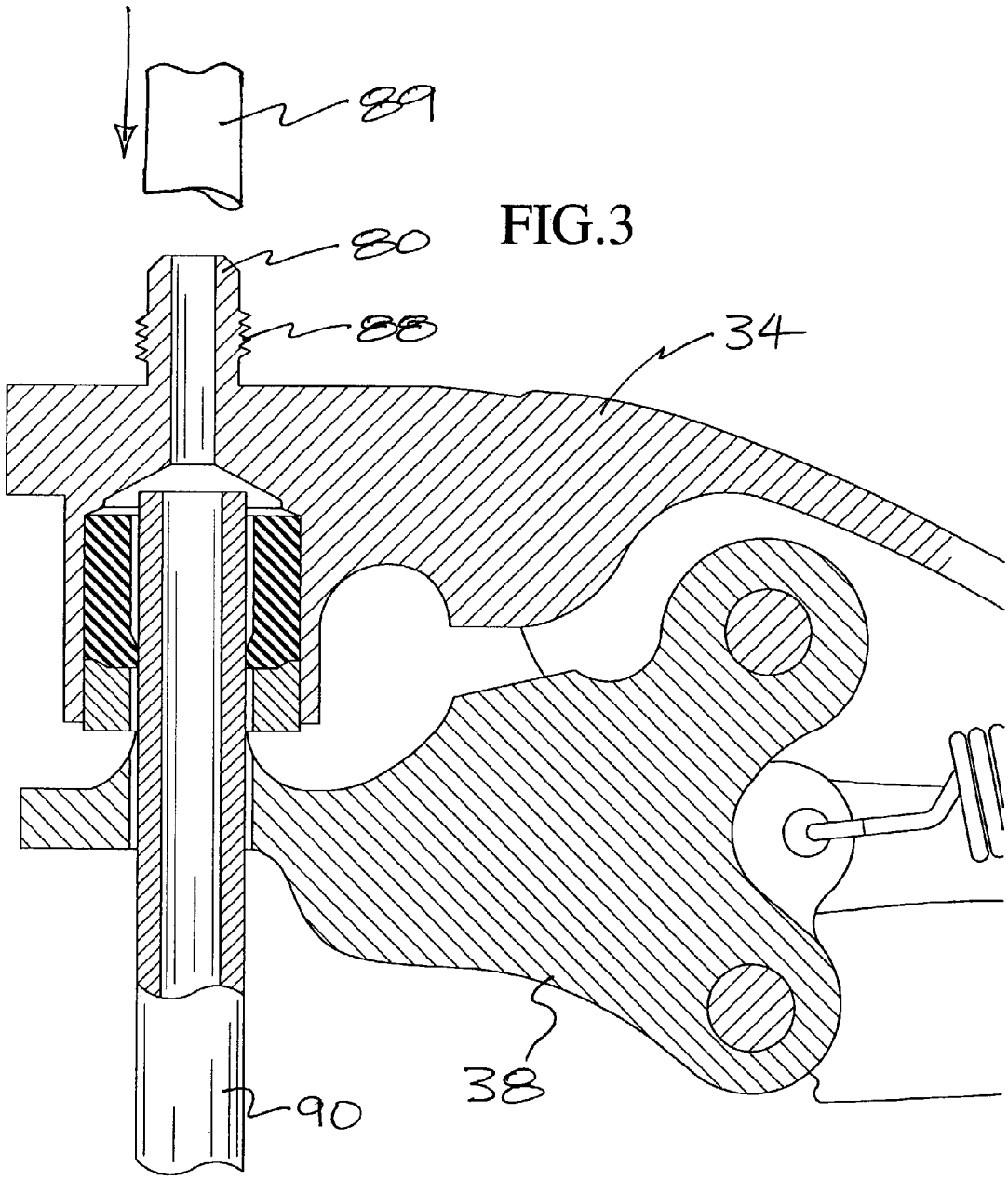
FIG. 3 is a view similar to FIG. 2 of the working end of the tool of FIG. 1 in a closed, engaged position, with an elongated object such as the illustrated piece of tubing engaged thereby.

FIG. 1-3 illustrate a tool 10 according to an embodiment of the invention.

Tool 10 includes a handle 14 which may be termed a fixed handle for convenience of discussion, and a handle 18, which may be termed a movable handle or locking handle for ease of discussion.

A linkage 22 may be provided for movably attaching locking handle 18 to fixed handle 14. Linkage 22 may be configured so that movement of handles 14 and 18 of the tool 10 relative to each other is accomplished in a desired fashion.

Working end 30 may include an upper jaw 34 and a lower jaw 38. Upper jaw 34 is shown as being provided on fixed handle 14 and lower jaw 38 is shown as being provided on movable handle 18. It will be appreciated that the linkage 22 may be selected so that upper jaw 34 and lower jaw 38 are switched, depending on the intended use, for example.

Upper jaw 34 may include a seat 40 having a passage 44 therethrough. A seal, sealing device, or sealing element 50 may be provided on working end 30, such as on upper jaw 34, as shown.

An aperture, passage, or seal passage 54 may be provided in seal 50. Seal passage 54 may be substantially aligned with passage 44.

One or both of passage 40 and seal passage 54 may be configured for receiving an elongated object, such as rod or piece of tubing therein.

A compression element 60 may be provided adjacent seal 50.

Compression element 60 may include a base 64 and an engaging element, such as a flange 68 extending away from base 64. A hole or passage 66 may be provided in compression element 60, passage 66 likewise being configured for receiving a rod or tube therethrough.

Lower jaw 38 may be provided with a base 70 and one or more extensions 74 extending away therefrom.

A lower or further passage 78 may be provided in lower jaw 38. Lower passage 78 may be configured and sized for receiving an elongated object, such as a rod or tube or pipe therein.

A coupling 80 may be provided on upper jaw 34, for example. Coupling 80 may be a male coupling 84, as shown, a female coupling, or any other joining element depending on the intended use. A coupling passage 88 may be provided in coupling 80. Depending on the intended use, coupling passage 88 may or may not be substantially aligned with passage 54. In the embodiment of FIG. 1, it will be appreciated that passage 88 need not be substantially aligned with passage 44 and, indeed, may be offset from passage 44, in the case where no piece of tubing or rod need be inserted into passage 88 and into passage 44.

Multiple couplings 80 having respective one or more passages 88 may be provided, some or all of which fluidly connect to passage 44, depending on the intended use, as will be readily appreciated.

In use, as shown, if tool 10 is to be used for connecting two (2) pieces of pipes or tubing, a first pipe 89 may be connected to coupling 88, such as by engaging the threads of male fitting 84, or by slipping a piece of flexible tubing over fitting 84. The other piece of tube 90 to be connected may be inserted through passage 78, out passage 78 past extension 74, into hole 66 of compression element 60, and be disposed adjacent seal 50.

A free end of that so disposed second tube 90 may typically extend sufficiently along a portion of seal 50 so that when tool 10 is in its engaging position, a seal is established between seal 50, the second piece of tube 90, and passage 44. In order to be disposed in the engaged position where passage 44, seal 50, and the second piece of tube 90 are sealingly engaged, the user will move moveable handle 18 counterclockwise as viewed in FIG. 1 toward fixed handle 14. In that manner, lower jaw 38 is moved clockwise toward upper jaw 34, as viewed in FIGS. 1-3.

As movement of lower jaw 38 continues, extension 74 will engage compression element 60, thus pushing compression element 60 upwardly further in the direction of coupling 80, shown in FIG. 2. Compression element 60 thus compresses seal 50, thereby distorting or moving seal 50 into engagement with the second piece of tubing 90 disposed adjacent thereto as well as further sealing engagement with the wall(s) defining passage 44. Thus, a seal is established between the second piece of tubing 90, seal 50 and passage 44. In that manner, assuming that a sufficient seal has been established between the first piece of tubing which engages coupling 80, then the first piece of tubing 89 on coupling 80 and the second piece of tubing 90 will have a sealed fluid connection established therebetween.

In the case where no first piece of tube is to be connected, the user could simply cap off or close coupling 80 by attaching a cap to coupling 80 to close passage 88. In that manner, tool 10 could be used to seal the open end of the second piece of tube inserted into and through lower 38 into upper jaw 34 in passage 44 and adjacent seal 50.

A variable grip actuator 100 may be provided on tool 10. Actuator 100 may be operably engaged with movable handle 18, such as via linkage 22, for varying the force with which lower jaw 38 engages upper jaw 34, for varying the length of movement of lower jaw 38 from its fully disengaged position to its fully engaged position, for example, and the like.

Figure 4:
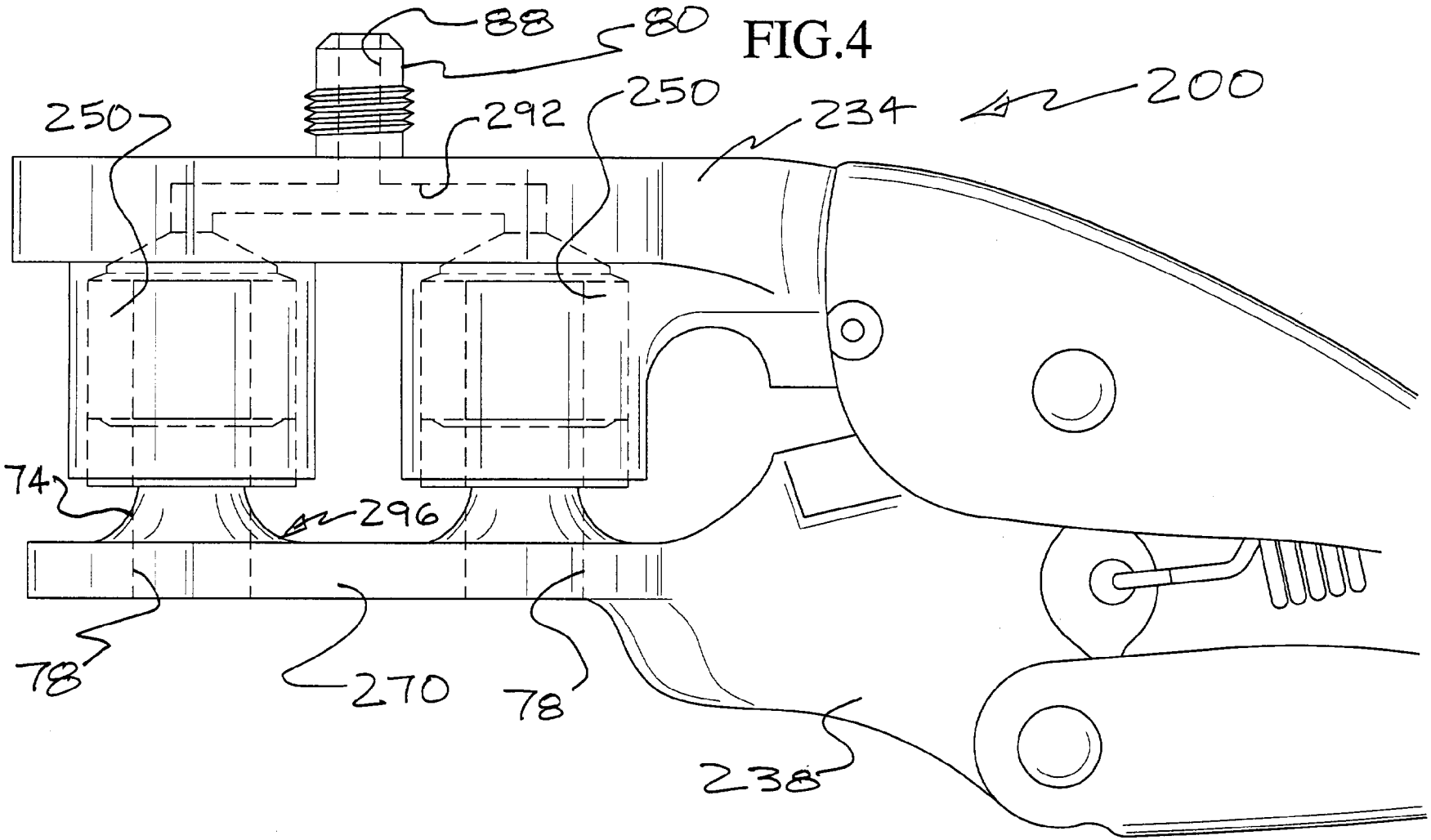
FIG. 4 is a side elevational view similar to FIG. 3 of another embodiment of a tool according to the invention in its closed, engaged position.

FIG. 4 illustrates another embodiment of a tool 200 according to the invention.

Tool 200 may include a coupling 80, and a plurality of passages 78 in a lower jaw 238.

A corresponding plurality of seals 250 may be provided in corresponding seats in an upper jaw 234.

A manifold or plurality of passages 292 may fluidly connect passage 88 with the plurality of passages 78 via passage 292. In that manner, the user may fluidly connect two (2) pieces of pipes inserted into respective ones of passages 78, engaged lower jaw 238, establish a seal between seals 250 and respective portions of manifold 292 and, hence, passage 88.

Depending on the number actuating elements 74, a region 296 between a base 270 and actuators 74 may be provided with a movable or pivotable coupling, such as by a pinned joint, to ensure that proper and sufficient movement of actuator 74 is achieved in order to engage seals 250 with rods or tubes disposed in passages 78 to establish the desired seal therebetween.

Figure 5:
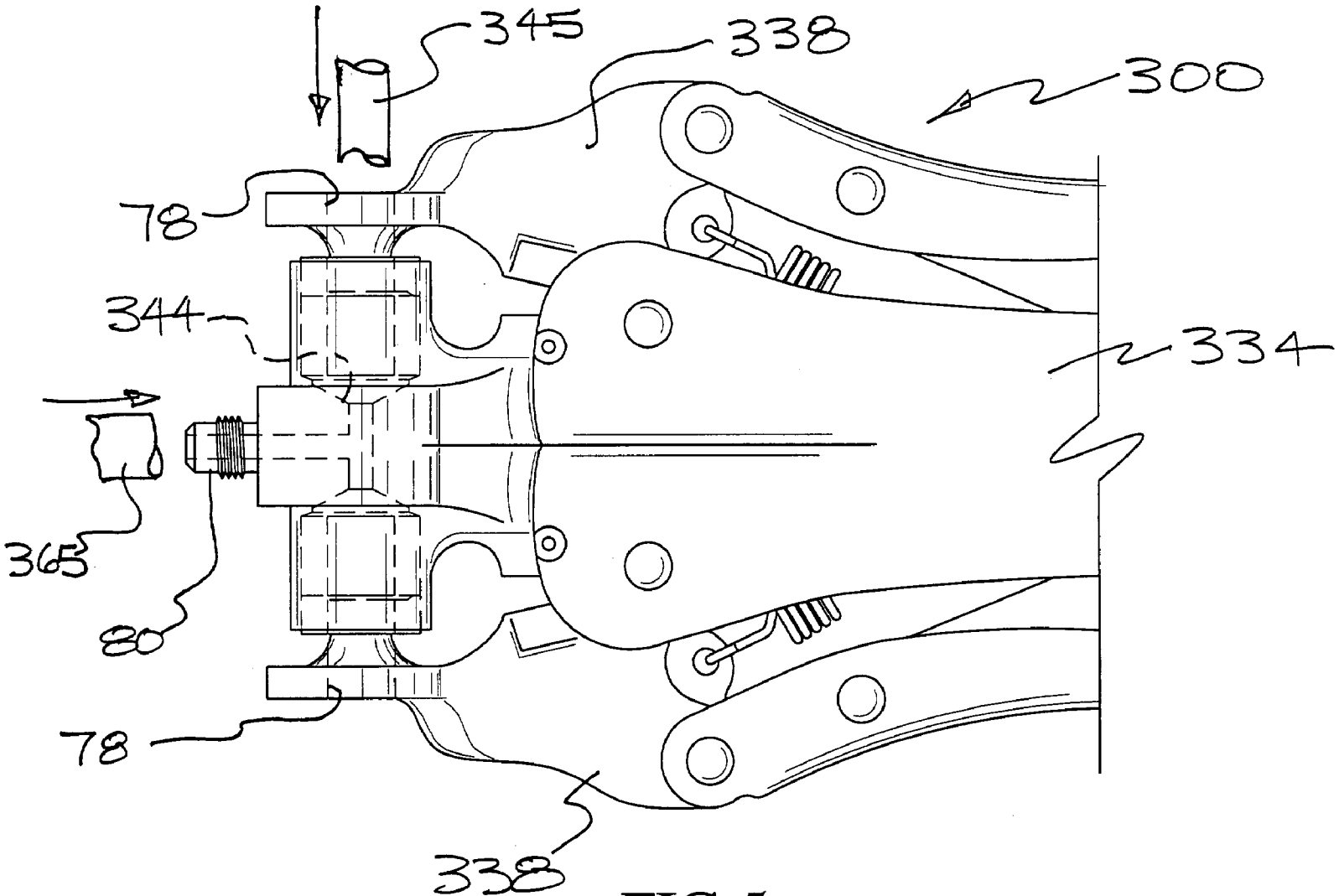
FIG. 5 is a side view of another embodiment of a tool according to the invention in its closed, engaged position.

FIG. 5 illustrates another embodiment of a tool 300 according to the invention.

Tool 300 may include a central handle 334 and two (2) or more handles 338 which are movable relative to handle 334. By use of tool 300, a first tube 345 and a second tube 355 may be inserted into respective openings 78 and further into the passage 344 in a manner similar to the use of the above-described embodiments. In this manner, tubes 345 and 355 may be fluidly connected with a seal established therebetween.

If two (2) tubes 345 and 355 are to be fluidly connected to a third tube or pipe 365 coupled to coupling 80, such may be readily accomplished. If no third tube is to be attached at coupling 80, a cap may be attached to coupling 80 to close off coupling 80.

Figure 6:
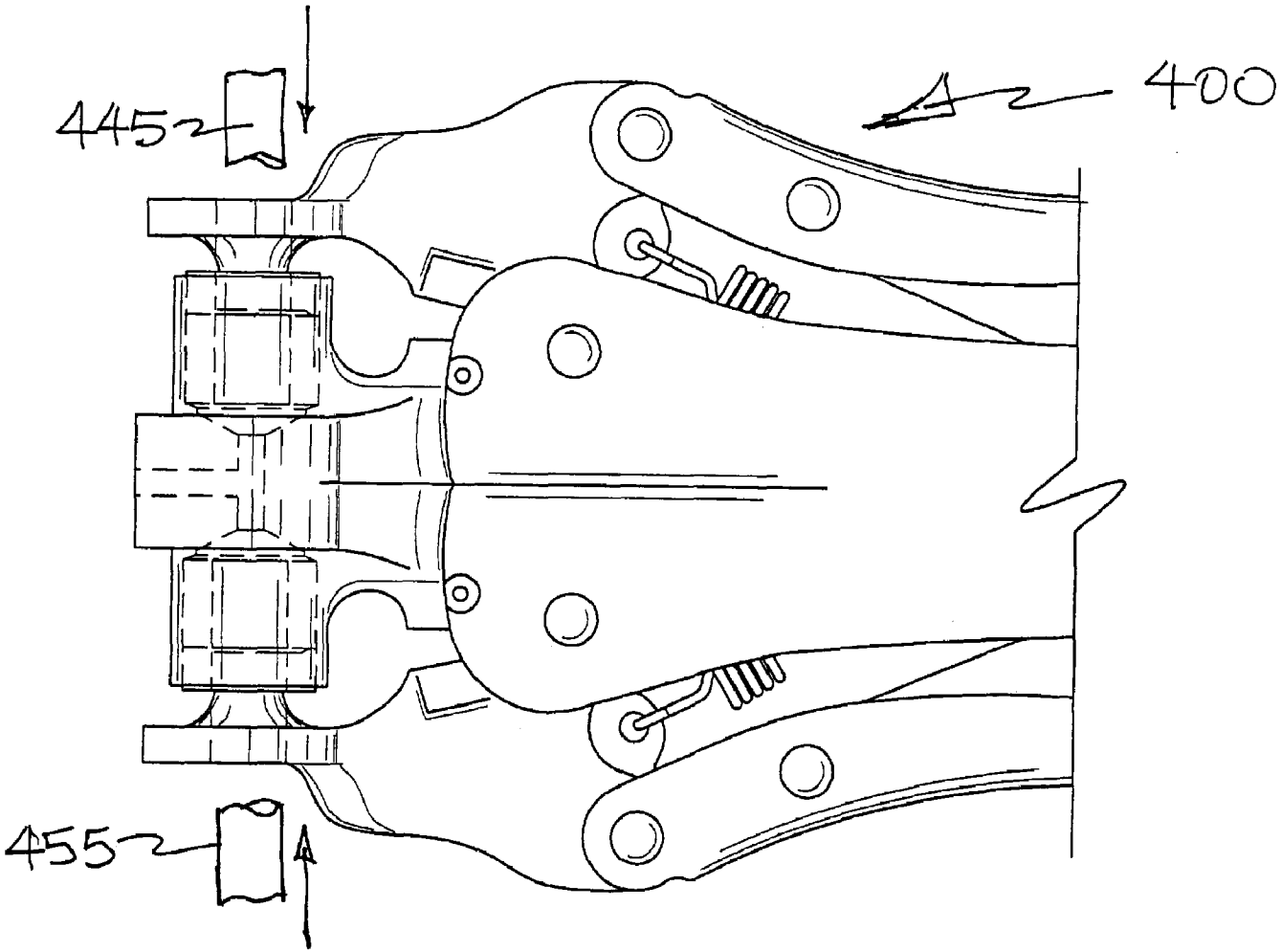
FIG. 6 is a view similar to FIG. 5 of a further embodiment of the invention in its engaged position.

FIG. 6 illustrates another embodiment of a tool 400 according to the invention.

Tool 400 is similar to tool 300 of FIG. 5, and coupling 80 has been eliminated. Tool 400 is particularly suited for use in situations where the user wishes to quickly connect a first pipe 445 to a second pipe 455.

In use, any of the embodiments may be used to securely engage a rod or tube simply for pulling on the rod or tube to manipulate it, without regard for the sealing achieved.

It is contemplated that the orientation and location of any of the couplings, such as coupling 80 of FIG. 2, and the movable engaging elements and apertures may be varied depending on the intended use.

The coupling 80 of FIG. 2, for example, may extend upwardly and rearwardly, or substantially rearwardly, toward the right as viewed in FIG. 2. In that manner, when work space is limited, the user may extend a tube to be connected to coupling 80 substantially along a portion of one or both jaw 34 and handle 14.

It is contemplated that various components such as compression element 60 may be magnetized to assist in retaining the components in the desired position.

Compression element 60 may be freely disposed in upper jaw 34 or detachably attached to upper jaw 34, such as by use of a snap ring. Compression element 60 may be made of steel, stainless steel, or a plastic, with or without a snap ring.

Compression element 60 may be attached to seal 50 to reduce parts, such as by bonding.

Compression element 60 may be attached by use of a fastener, such as a screw, or by a hinge, or by another fastening element.

As described above, there may be multiple compression zones for sealingly engaging an elongated object along its length and/or sealingly engaging one or more parts or one or more object disposed in respective passages of working end 30.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

What is claimed is:

1. A tool, comprising:

a) a base;

b) a working end provided on the base;

c) a passage provided in the working end, the passage being configured for receiving an elongated object to be worked therein;

d) a seal provided adjacent to the passage, the seal being configured for allowing insertion of an elongated object into the passage when the seal is in a disengaged condition;

e) an actuator provided adjacent the working end of the base, the actuator being configured for moving between an engaged position and a disengaged position, the engaged position being a position in which the actuator causes the seal to assume the engaged position of the seal, the disengaged position of the actuator being a position in which the actuator sufficiently disengages so that the seal can assume a disengaged position;

f) a compression element provided adjacent the seal, the compression element being configured for being engaged by the actuator;

g) the compression element including a base and a flange, the flange extending away from the base toward the seal, and the flange being configured for deforming the seal and causing the seal to sealingly engage with an elongated object disposed in the passage when an elongated object is disposed in the passage and the actuator is in the engaged position of the actuator; and h) wherein, when the actuator is in the disengaged position of the actuator and the seal is in the disengaged position of the seal, an elongated object can be inserted into the passage and be disposed substantially adjacent the seal, and when the actuator is moved into the engaged position of the actuator and causes the seal to assume the engaged position of the seal, an elongated object disposed in the passage adjacent to the seal is sealingly engaged by the seal to establish a seal between the elongated object, the seal, and the passage.

2. The tool as in claim 1, wherein:

a) the seal includes a resilient seal.

3. The tool as in claim 2, wherein:

a) the resilient seal includes a bushing with a seal passage, the seal passage being substantially aligned with the passage in the working end, and the seal passage being configured for allowing an elongated object to be inserted.

4. The tool as in claim 2, wherein:

a) the seal includes an elastomeric bushing.

5. The tool as in claim 1, wherein:

a) a connector is provided on the working end of the base, the connector being configured for connection to a piece of tubing.

6. The tool as in claim 1, wherein:

a) the tool is a hand tool; and b) the actuator includes a hand-actuated actuator.

7. The tool as in claim 1, wherein:

a) an aperture is provided in the actuator, the aperture being configured for receiving an elongated object therein; and b) wherein when an elongated object is received in the passage of the working end and disposed adjacent the seal, a further elongated object may extend through the aperture of the actuator into the passage from another end of the passage, and be disposed adjacent the seal, the seal sealingly engaging an elongated object and a further elongated object, and the seal sealingly engaging at least one of the aperture and the passage, when the actuator is in the engaged position of the actuator.

8. The tool as in claim 1, wherein:

a) the tool is a hand tool and the actuator is hand-actuatable.

9. The tool as in claim 1, wherein:

a) the compression element includes a magnetic material.

10. The tool as in claim 1, wherein:

a) the compression element includes a plastic.

11. The tool as in claim 1, wherein:

a) the compression element is detachable.

12. The tool as in claim 1, wherein:

a) a movable handle is provided; and b) the actuator is provided on the movable handle.

13. The tool as in claim 12, wherein:

a) the seal is provided in a further handle.

14. The tool as in claim 12, wherein:

a) a further handle is provided, the further handle being movable relative to the handle; and b) a further actuator is provided in the further handle;

c) a further passage is provided in the further handle, the further passage being configured for receiving an elongated object to be worked therein;

d) a further seal is provided adjacent to the further passage, the further seal being configured for allowing insertion of an elongated object into the further passage when the further seal is in a disengaged condition;

e) a further actuator is provided on the further handle, the further actuator being configured for moving between an engaged position and a disengaged position, the engaged position being a position in which the further actuator causes the further seal to assume an engaged position, the disengaged position of the further actuator being a position in which the further actuator sufficiently disengages so that the further seal can assume the disengaged position of the further seal; and f) wherein, when the further actuator is in the disengaged position of the further actuator and the further seal is in the disengaged position of the further seal, an elongated object can be inserted into the further passage and be disposed substantially adjacent the further seal, and when the further actuator is moved into the engaged position of the further actuator and causes the further seal to assume the engaged position of the further seal, an elongated object disposed in the further passage adjacent to the further seal is sealingly engaged by the further seal to establish a further seal between the elongated object, the further seal, and the further passage.

15. A tool, comprising:

a) a base;

b) a working end provided on the base;

c) a passage provided in the working end, the passage being configured for receiving an elongated object to be worked therein;

d) a seal provided adjacent to the passage, the seal being configured for allowing insertion of an elongated object into the passage when the seal is in a disengaged condition;

e) an actuator provided adjacent the working end of the base, the actuator being configured for moving between an engaged position and a disengaged position, the engaged position being a position in which the actuator causes the seal to assume the engaged position of the seal, the disengaged position of the actuator being a position in which the actuator sufficiently disengages so that the seal can assume a disengaged position;

f) a connector provided on the working end of the base, the connector being configured for connection to a piece of tubing;

g) the connector being a male connector;

h) a connector passage provided in the male connector and being substantially aligned with the passage in the working end; and i) wherein, when the actuator is in the disengaged position of the actuator and the seal is in the disengaged position of the seal, an elongated object can be inserted into the passage and be disposed substantially adjacent the seal, and when the actuator is moved into the engaged position of the actuator and causes the seal to assume the engaged position of the seal, an elongated object disposed in the passage adjacent to the seal is sealingly engaged by the seal to establish a seal between the elongated object, the seal, and the passage.

16. The tool as in claim 15, wherein:

a) the tool is a hand tool; and b) the actuator includes a hand-actuated actuator.

17. The tool as in claim 15, wherein:

a) an aperture is provided in the actuator, the aperture being configured for receiving an elongated object therein; and b) wherein when an elongated object is received in the passage of the working end and disposed adjacent the seal, a further elongated object may extend through the aperture of the actuator into the passage from another end of the passage, and be disposed adjacent the seal, the seal sealingly engaging an elongated object and a further elongated object, and the seal sealingly engaging at least one of the aperture and the passage, when the actuator is in the engaged position of the actuator.

18. The tool as in claim 15, wherein:

a) the tool is a hand tool and the actuator is hand-actuatable.

19. A tool, comprising:

a) a base;

b) a working end provided on the base;

c) a passage provided in the working end, the passage being configured for receiving an elongated object to be worked therein;

d) a seal provided adjacent to the passage, the seal being configured for allowing insertion of an elongated object into the passage when the seal is in a disengaged condition;

e) an actuator provided adjacent the working end of the base, the actuator being configured for moving between an engaged position and a disengaged position, the engaged position being a position in which the actuator causes the seal to assume the engaged position of the seal, the disengaged position of the actuator being a position in which the actuator sufficiently disengages so that the seal can assume a disengaged position;

f) a manifold provided in the base, the manifold including a plurality of passages;

g) a respective seal provided each one of the plurality of passages;

h) a further actuator provided adjacent each of the plurality of passages, each further actuator being configured for movement into an engaged position engaging at least one of the respective seals and sealingly engaging the at least one of the respective seals with a respective elongated object disposed adjacent the respective seal, so that at least one of a plurality of elongated objects can be disposed in a respective one of the plurality of passages adjacent respective seals and be sealingly engaged by the seal when the at least one of the plurality of actuators is in the respective engaged position of the at least one actuator; and i) wherein, when the actuator is in the disengaged position of the actuator and the seal is in the disengaged position of the seal, an elongated object can be inserted into the passage and be disposed substantially adjacent the seal, and when the actuator is moved into the engaged position of the actuator and causes the seal to assume the engaged position of the seal, an elongated object disposed in the passage adjacent to the seal is sealingly engaged by the seal to establish a seal between the elongated object, the seal, and the passage.

20. The tool as in claim 19, wherein:

a) the tool is a hand tool and the actuator is hand-actuatable.

* * * * *